United States Patent [19]

Bottinelli et al.

[11] Patent Number: 4,931,090

[45] Date of Patent: Jun. 5, 1990

[54] PNEUMATIC STEELMAKING VESSEL AND METHOD OF PRODUCING STEEL

[75] Inventors: N. Edward Bottinelli, Dallas, Tex.; Norman L. Kotraba, Tega Cay, S.C.

[73] Assignee: Zia Technology, Inc., Dallas, Tex.

[21] Appl. No.: 397,388

[22] Filed: Aug. 23, 1989

[51] Int. Cl.[5] ..... C21C 7/00

[52] U.S. Cl. ..... 75/10.16; 266/217; 75/10.17; 75/543

[58] Field of Search ..... 75/59.1, 46, 53, 58

[56] References Cited

U.S. PATENT DOCUMENTS

| | | | |
|---|---|---|---|
| 3,971,655 | 7/1976 | Takashima | 75/59.1 |
| 4,036,635 | 7/1977 | Klapdar | 75/58 |
| 4,517,019 | 5/1985 | Taniguichi | 75/53 |
| 4,541,865 | 9/1985 | Sherwood | 75/46 |
| 4,740,242 | 4/1988 | Nakamura | 75/59.1 |

*Primary Examiner*—Peter D. Rosenberg
*Attorney, Agent, or Firm*—Ralph H. Dougherty

[57] ABSTRACT

The invention encompasses a pneumatic steelmaking vessle and a method for the production of steel from hot carbon-bearing metallized raw materials such as direct reduced iron. The vessle is a refractory-lined ladle, having an eccentric ladle cover with an opening on one side. Opposite the opening in the ladle cover is at least one downwardly directed oxygen lance or tuyere. The vessel is mounted on trunnions for rotation about its central axis to a generally horizontal position. The bottom of the vessel has a porous plug, and a hot metal outlet controlled by a sliding gate closure member or other convenient type closure. The vessel is used in connection with a method of steelmaking by serving as the means for transporting molten metal to melting, refining, ladle metallurgy, and teeming operations.

19 Claims, 7 Drawing Sheets

58
59
66
40
64
42
46
44
16
29
63
48
34
32
10
68
10
10
10
51
16
24
12
16
72
65
14
15
24
56
52
28
74

Fig. 8
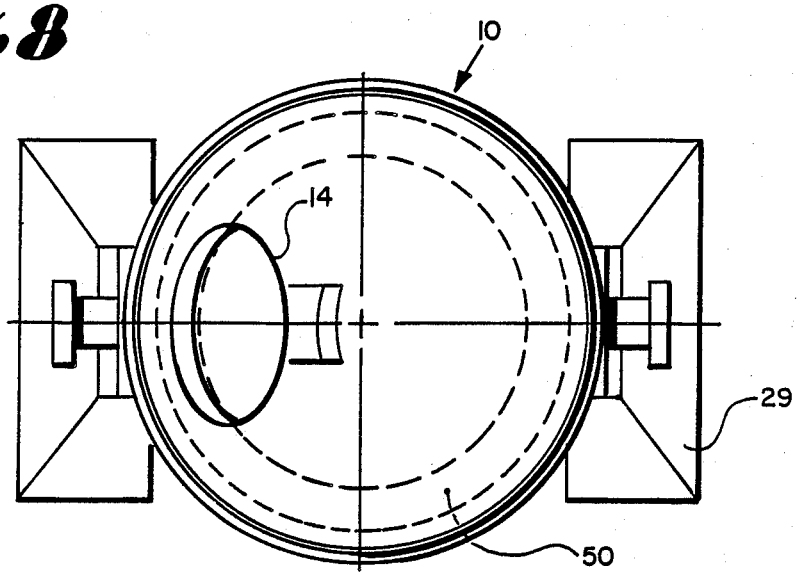
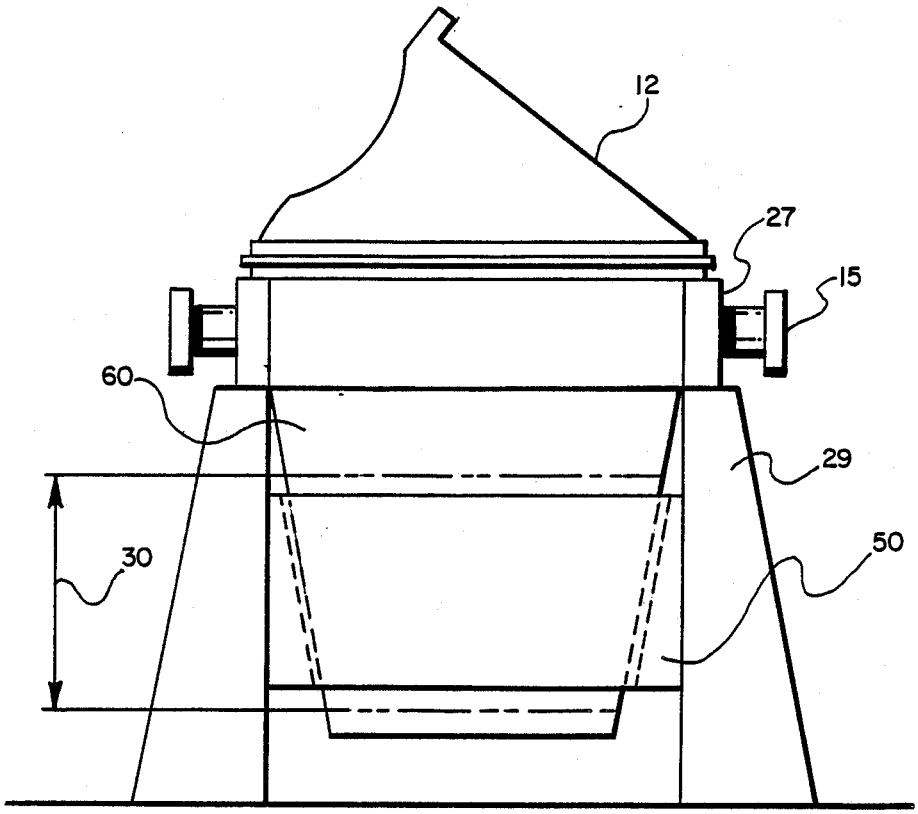
Fig. 9

PNEUMATIC STEELMAKING VESSEL AND METHOD OF PRODUCING STEEL

BACKGROUND OF THE INVENTION

1. Field of the Invention

The present invention generally relates to steelmaking and, more particularly, is concerned with a pneumatic steelmaking vessel and a method for the production of steel from hot carbon-bearing raw materials such as Direct Reduced Iron (hereinafter "DRI").

2. Description of the Prior Art

The invention encompasses a pneumatic steelmaking vessel and a method for the production of steel from hot carbon-bearing raw materials such as DRI. The vessel is substantially a ladle having an eccentric top with an opening on one side. Opposite the opening in the top is at least one downwardly directed oxygen lance or tuyere. The vessel is mounted on trunnions for rotation about its central axis to a generally horizontal position. The bottom of the vessel has a porous plug, and a hot metal outlet controlled by a sliding gate closure member or other convenient type closure. The vessel is used in connection with a method of steelmaking by serving as the means for transporting molten metal to melting, refining, ladle metallurgy, and teeming operations.

There are several significant advantages that the invention provides over other melting, refining, ladle metallurgy and teeming systems in current commercial operation.

First, metal is melted and refined in the same vessel as is used to transport the molten metal to subsequent operations. In current practice, the metal is melted and refined in a separate furnace such as an electric arc furnace, basic oxygen furnace, energy optimizing furnace, induction furnace or other known device and then tapped from this device into a ladle for transport. Not having to transfer the molten metal into a ladle for transport has significant advantages over the current practice. There is a substantial temperature loss occasioned in current practice because even a preheated receiving ladle is almost always cooler than the molten steel and extracts heat until the differing temperatures equalize. A second temperature loss occurs in current practice due to the exposure of the molten stream to the atmosphere during the transfer operation. This is analogous to cooling a cup of hot liquid by pouring it back and forth between two cups.

Second, oxidation of non-metallics in the molten steel will occur by exposure of the metal stream to atmospheric oxygen during the transfer operation. These non-metallic oxides become inclusions in the final product, lowering its overall quality. Of paramount importance to the production of high quality clean steel is minimal contact with the atmosphere.

Third, in current practice, transfer ladles are fitted with removable covers during transport to minimize temperature losses by radiation through a normally open ladle. The present vessel is equipped with an integral top that performs this same function without having to be fitted and removed at various stations.

Fourth, under current practices, repair or relining of the melting furnace requires a complete shutdown of the melting functions associated with that furnace until the work is completed. The invented vessel can be repaired off-line and a repaired vessel inserted in its place with no loss of production.

Fifth, the invented vessel has an integral yet removable top into which is fitted at least one tuyere. Since most refractory wear is associated with the area immediately adjacent to the tuyeres due to the action of the injected gases, a vessel can be removed from service and fitted with a rebuilt (or relined) top section without the necessity of relining the entire vessel with new refractory. It is anticipated that each vessel will be refitted with several rebuilt (or relined) top sections before it becomes necessary to replace the refractory lining in the vessel body.

Sixth, because the top section is removable from the body of the vessel, refractory replacement in either section is simplified. Both are basically conical sections and adaptable to automatic ladle lining by the use of ramming machines. Rammed monolithic linings are preferred over laid-upon brick linings for their lower cost and potentially longer life.

Seventh, the use of hot DRI pellets contributes to the thermal efficiency that makes the invented method possible without external energy sources. Hot DRI pellets can only be obtained from a facility located immediately adjacent to the steelmaking facility. The technology described in Holley U.S. Pat. No. 3,836,353, entitled "PELLET RECLAMATION PROCESS," makes such an arrangement feasible.

Eighth, the use of hot DRI pellets containing a least 2% carbon eliminates the need for the complicated addition of carbon into the vessel by injection tuyeres or other similar devices. It also eliminates the need to provide the crushing, storage and transport systems needed to inject carbon. Again, the Holley process is capable of producing hot DRI pellets containing at least 2% carbon, which is not possible with other direct reduction processes currently in operation.

The applicants are aware of the following U.S. patents concerning related metallurgical methods and apparatus.

| U.S. Pat. No. | Issue Date | Inventor | Title |
|---|---|---|---|
| 253,046 | Jan. 31, 1882 | HENDERSON | BESSEMER-STEEL PLANT |
| 3,746,325 | Jul. 17, 1973 | FREEBERG, et al | BASIC OXYGEN STEEL MAKING FACILITY AND METHOD OF OXYGEN REFINING OF STEEL |
| 429,337 | June 3, 1890 | COLLIN | CONVERTER LADLE |
| 3,502,313 | Mar. 24, 1970 | PASTORIUS | STEEL PRODUCING PLANT WITH UMBILICALLY OPERATIVE FURNACE TOP MEANS |
| 3,484,088 | Dec. 16, 1969 | PERE | MULTI-CONVERTING PNEUMATIC STEELMAKING PLANT |
| 3,477,705 | Nov. 11, 1969 | MOBLEY | STEEL MAKING |

-continued

| U.S. Pat. No. | Issue Date | Inventor | Title |
|---|---|---|---|
| | | | APPARATUS |
| 3,411,764 | Feb. 17, 1966 | FALK | STEELMAKING PLANT HAVING A MOBILE, STRADDLE CARRIAGE CONVERTER SUPPORT |
| 3,013,789 | Dec. 17, 1959 | SAYRE, et al | MOBILE APPARATUS FOR OXYGEN REFINING OF METAL |
| 2,803,450 | Sept. 29, 1953 | McFEATERS | CONVERTER GAS CLEANING SYSTEM |
| 741,505 | Oct. 13, 1903 | KIRK | MELTING FURNACE |
| 51,401 | Dec. 5, 1865 | BESSEMER | IMPROVEMENT IN THE MANUFACTURE OF MALLEABLE IRON AND STEEL |
| 2,065,691 | Jul. 8, 1933 | HANSON, et al | CUPEL FURNACE |
| 574,127 | Dec. 29, 1896 | AIKEN | HOISTING APPARATUS |

Henderson illustrates a trunnion-mounted Bessemer converter for making steel, which is mobile and moveable along beams.

Freeberg illustrates a basic oxygen steelmaking facility which includes mobile furnaces that may be moved along tracks. According to this patent "this arrangement makes possible an operation in which each of the two furnaces are charged in succession, blown with oxygen in succession, and thereafter tapped and recycled, so that one conventional blowing station can serve each of the furnaces while the preblowing and postblowing operations are carried out elsewhere."

Collin shows a rail-mounted, hot-metal ladle which is charged with molten metal from a furnace while in the upright position and blown when inclined or horizontal. The tuyeres are generally centered in the ladle cover, and the taphole in the ladle cover apparently also acts as the charging hole.

Pastorius allegedly shows and illustrates "a steel producing plant providing a consecutive series of stations for standby, loading, preheating, blowing, degassing, blocking, pouring, or discharge with a carriage supporting a refractory line steel producing vessel to move through the consecutive series of stations for the melting and refinement of steel." Each operation is conducted at a separate location. It is also alleged that "the vessel becomes in effect a ladle after the steel is properly made and may then pass to a second holding station to determine if the additives properly reacted." The vessel is top blown with oxygen, and the blowing station has a removable cover. The vessel is moved without a cover or hood.

Pere illustrates a multi-converter pneumatic steelmaking plant in which the top blown converters are arranged in carrousel formation.

Mobley illustrates steelmaking apparatus for oxygen refining of steel utilizing a succession of movable furnaces moveable along a track way. Each furnace has a flue at each end for communication with the flue of an adjacent furnace. An oxygen lance is included in the roof of each furnace for top blowing.

Falk illustrates a steelmaking plant having a mobile carriage-mounted converter, which may also be used for alloying operations.

Sayre illustrates a track-mounted hot metal car which operates as a mobile furnace apparatus for use in oxygen refining of steel.

McFeaters teaches a rail mounted converter with an off-set mouth, as best shown in his FIG. 6, which is mounted for rotation about trunnions for charging, blowing, and discharging or dumping. The converter has a top blown oxygen lance.

Kirk shows a trunnion-mounted unitary bottom-blown vessel, with a similar configuration to a Bessemer converter.

Bessemer illustrates that bottom-blown steelmaking vessels have been known since at least 1865.

Neither Hanson U.S. Pat. No. 2,065,691 nor Aiken U.S. Pat. No. 574,127 presents any material which is strongly applicable to the subject invention.

Each of the prior art references cited above suffer from the disadvantages of low thermal efficiency, and other disadvantages previously discussed. Applicants are unaware of any prior art steelmaking vessel that accomplishes the objects of the present invention. Consequently, a need exists for a pneumatic steelmaking vessel and a method for the production of steel from hot carbon-bearing raw materials such as DRI which will result in improved steelmaking.

SUMMARY OF THE INVENTION

The present invention is an innovative pneumatic steelmaking vessel and a method for the production of steel, which overcomes the problems and satisfies the needs previously considered.

The invented vessel is substantially a ladle, having a removable eccentric top or cover with an opening on one side of the cover. Opposite the opening in the top is at least one downwardly directed oxygen lance or tuyere. The vessel is mounted on trunnions for rotation about its central axis to a generally horizontal position. The bottom of the vessel has a porous plug, and a hot metal outlet controlled by a sliding gate closure member or other convenient type closure. In operation, the vessel is used in a method of steelmaking by serving as the means for transporting molten metal to melting, refining, ladle metallurgy, and teeming operations, as well as the vessel in which such operations take place.

OBJECTS OF THE INVENTION

The principal object of the present invention is to provide means for melting and refining of metal and transporting the molten metal to subsequent steelmaking operations without transferring the metal to a transport vessel.

It is another object of the invention to provide a steelmaking vessel wherein all steelmaking operations can be accomplished.

Another object of the invention is to provide a means for avoiding oxidation of non-metallics in molten steel from exposure of the metal stream to atmospheric oxygen during the transfer operation.

Another object of the inventionis to provide a vessel having a removable tightly fitting cover to minimize temperature losses by radiation.

Another object of the invention is to provide a means for avoiding downtime and loss of production in a steelmaking plant.

Another object of the invention is to provide a vessel that can be removed from service and fitted with a rebuilt refractory top section without the necessity of installing new refractory in the entire vessel.

Another object of the invention is to provide a simple refractory replacement method by using ramming machines to automatically line the top and bottom portions of the vessel with refractory.

Another object of the invention is to provide a steelmaking process that requires only minimal external energy sources.

It is also an object of this invention to provide a method for converting carbon-containing iron oxides directly to steel in a single vessel.

Another object of the invention is to provide a method for increasing the thermal efficiency of a steelmaking process by utilizing hot DRI pellets as feed material.

It is also an object of the invention to eliminate the need for the complicated addition of carbon into the vessel by injection tuyeres or other similar devices, and to eliminate the need to provide the crushing, storage and transport systems normally required for carbon injection.

BRIEF DESCRIPTION OF THE DRAWINGS

The foregoing and other objects will become more readily apparent by referring to the following detailed description and the appended drawings in which:

FIG. 8 is a plan view of the vessel at an induction heating station.

FIG. 9 is a front elevation of the vessel at an induction heating station, showing the preferred induction heating apparatus for use with the present invention.

DETAILED DESCRIPTION

Figure 1:
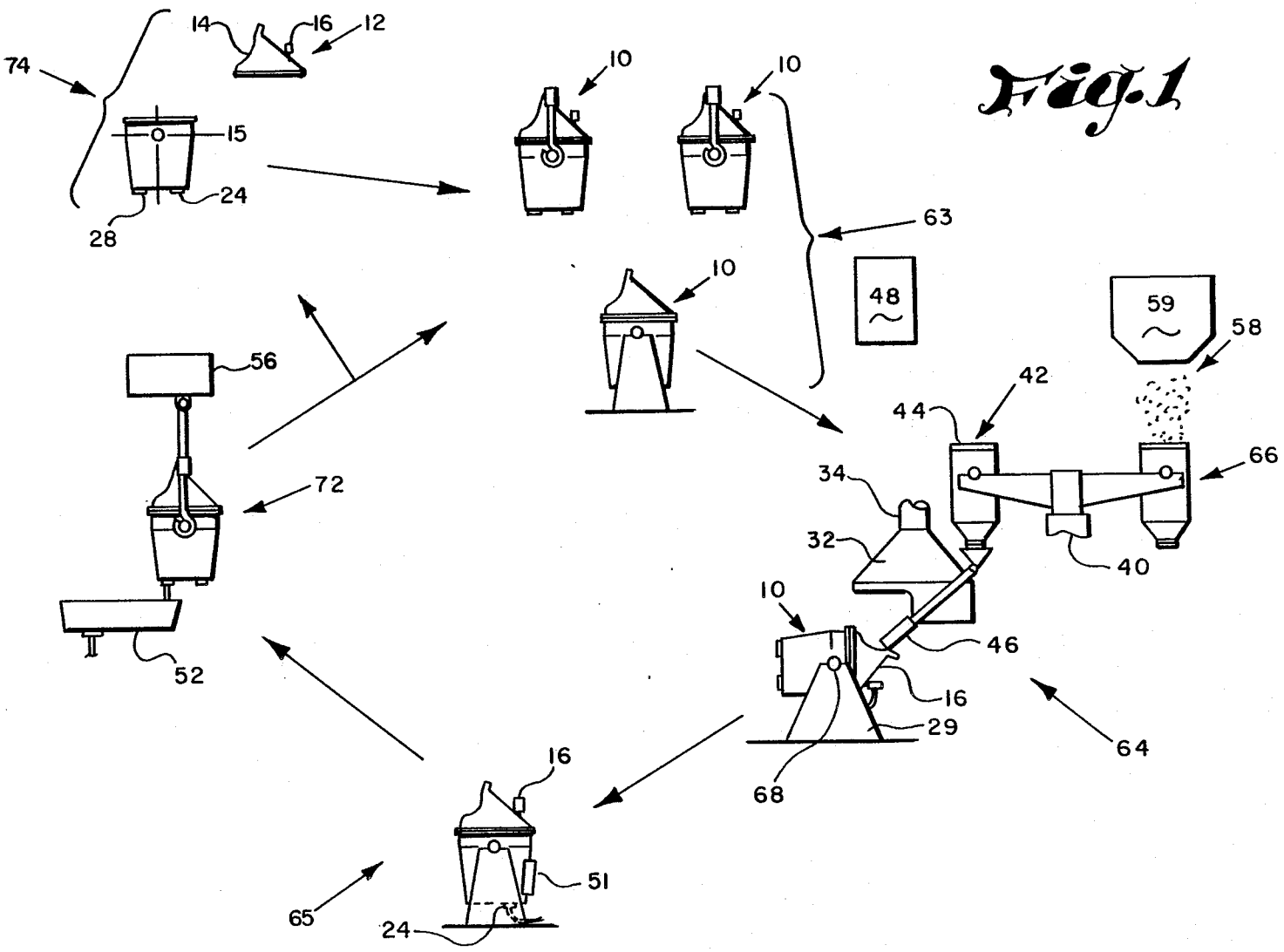
FIG. 1 is a flow chart showing the operations and movements of the vessel in accordance with the invention.

Referring now to the drawings, and more particularly to FIG. 1, a vessel 10, in which melting and refining of hot DRI pellets 58 (about 800 C.) containing sufficient carbon (in excess of 2.0%) is carried out in a concurrent process, serves not only as the melting and refining furnace, but also as the transfer ladle to transfer the molten steel though subsequent ladle refining steps and the final teeming operation. A plurality of vessels 10 are held in a holding area 63 and placed into service as others are removed from service for repair.

Figure 2:
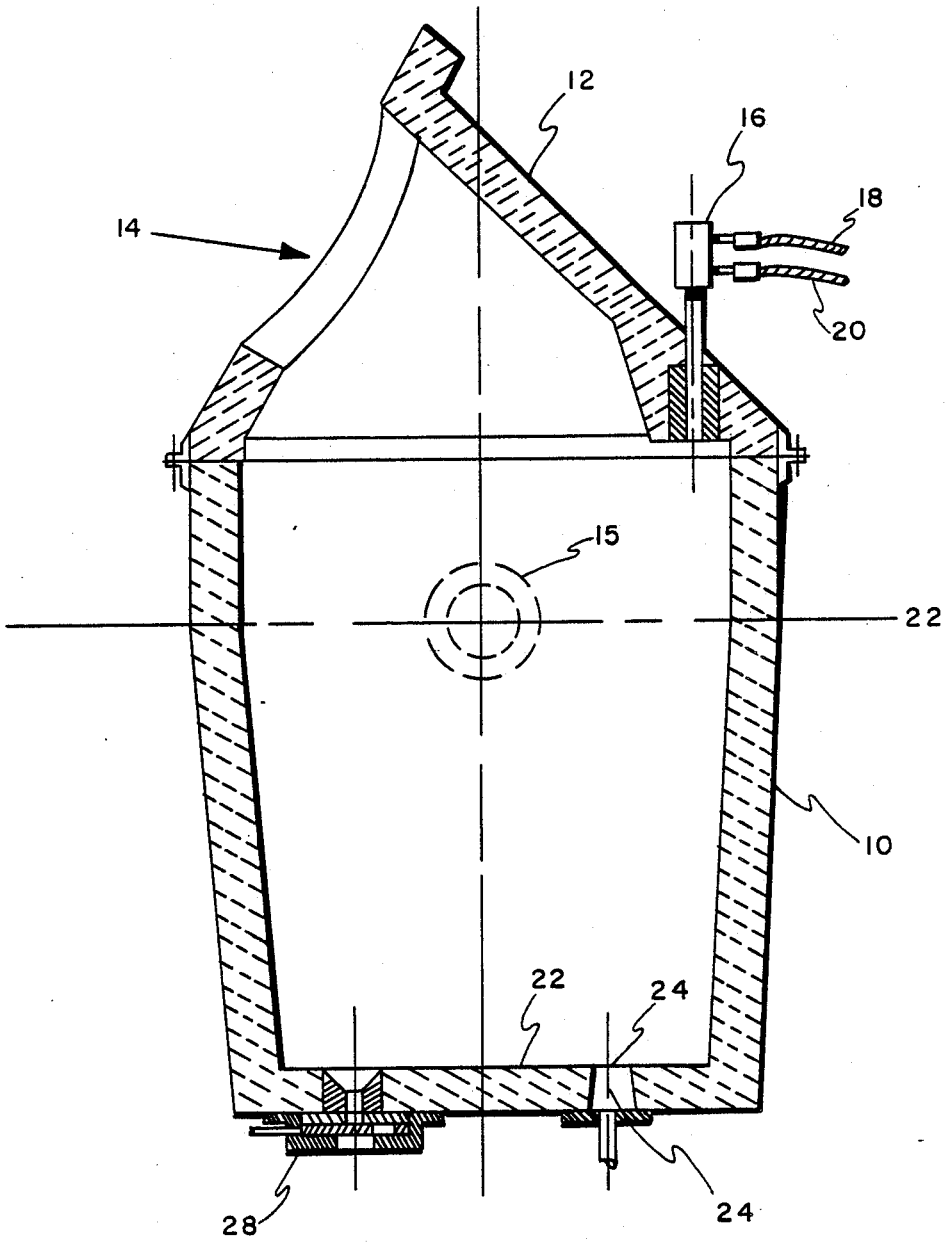
FIG. 2 is a sectional elevation of the vessel in the vertical position.

The vessel 10 is generally a refractory lined ladle fitted with a refractory lined top or cover 12, which is removable for relining and maintenance as is shown in FIG. 2, and a having refractory lined bottom 22. The vessel is mounted on trunnions 15 for rotation about the trunnion axis to a generally horizontal position. The trunions can be provided with any desirable rotation device such as a gear or cog 27 best shown in FIG. 9. The gear 27 engages a mating power-driven gear in the trunion support 29. The ladle cover 12 is generally conical, preferably slightly truncated, and has a charging opening 14 on one side of the cone. The cover is also equipped with at least one tuyere 16, oxygen lance, or similar device, near its side opposite the charging opening 14, for injecting commercially available gaseous oxygen under the surface of and directly into a bath of liquid iron or steel. The number of such injection devices is proportional to the volumetric or tonnage capacity of the vessel, i.e., the greater the capacity, the more injection devices are required in order to keep processing time to a maximum of approximately 60 minutes per heat.

It is generally accepted and known to those skilled in the art of pneumatic steelmaking, that it is preferable to inject gaseous oxygen into a molten iron or steel bath so as to create a multitude of small bubbles rather than a single large plume. Therefore, it is desirable to have a multiplicity of smaller injection devices rather than a single large unit.

The refractory lined bottom vessel 22 is provided with a porous plug 24 in its bottom, for stirring the liquid metal into the vessel by introducing inert gas through the plug and bubbling the gas through the metal to promote homogeneity of chemistry and temperature.

The vessel 10 is also fitted with a conventional sliding gate type tapping valve 28 for draining the liquid steel or liquid iron produced by the process into the tundish 52 of a conventional continuous casting machine 54 (see FIG. 1) for the production of billets, blooms or slabs or into molds for the production of ingots or other cast forms.

The vessel 10 is adapted to serve not only as a furnace for melting DRI pellets 58, along with added iron or steel scrap for temperature control, and the concurrent refining of the molten and melting DRI pellets 58, but also as the ladle for the resultant molten metal through subsequent metal refining or ladle refining facilities and as the teeming ladle for the ultimate casting of the refined metal into billets, blooms, slabs, ingots or other cast shapes.

If it is desired to process the molten metal in a subsequent metal refining or ladle refining facility in which temperature is to be adjusted, in addition to chemistry, a stainless steel, non-magnetic section 30 is inserted into the vessel sidewall to replace the normal carbon steel vessel shell 60 in that area. The panel 30 accommodates the use of an induction coil 50 for electro-magnetic heating and accompanying stirring, as is common in ladles to be used in induction heating furnace stations. In this instance, the induction coil 50 is a permanent part of the ladle furnace facility, as shown in FIG. 9, and the vessel 10 is situated with the non-magnetic section within the coil at this location, i.e., the coil surrounds the non-magnetic portion of the vessel, to accomplish the induction heating and stirring functions.

Figure 7:
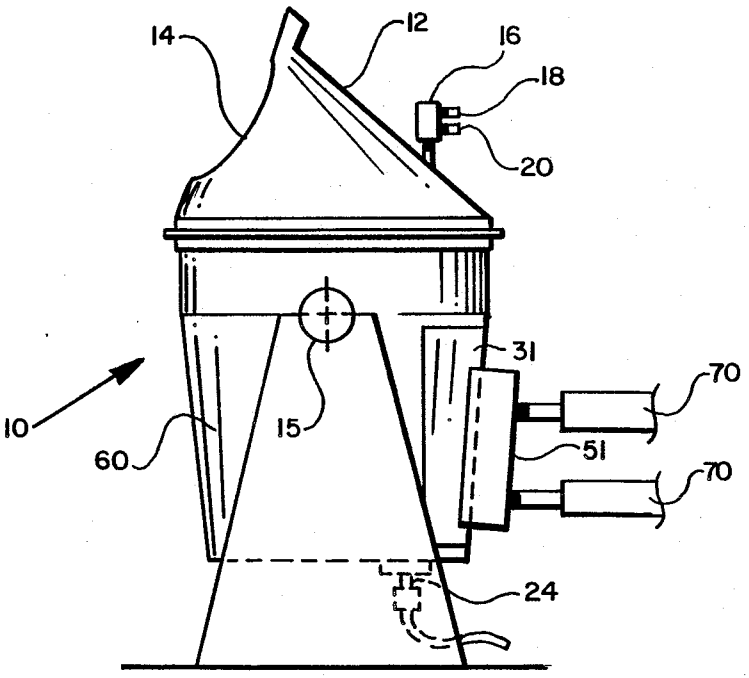
FIG. 7 is an elevational view of the vessel at the ladle metallurgy station, with attached induction coil.
Figure 6:
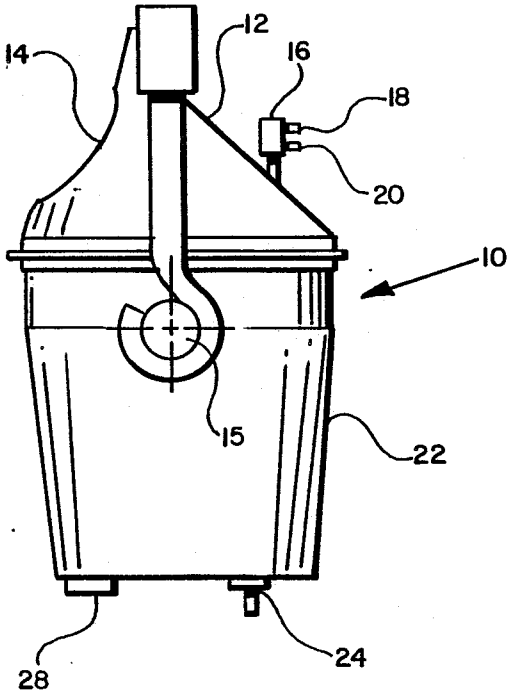
FIG. 6 is an elevational view of the vessel in the transport position.

Alternatively, a non-magnetic stainless steel panel 31 may be inserted into the steel shell of vessel 10 and an induction coil 51 affixed to the vessel against this panel, as shown in FIG. 7, to accomplish the heating and stirring functions.

Figure 3:
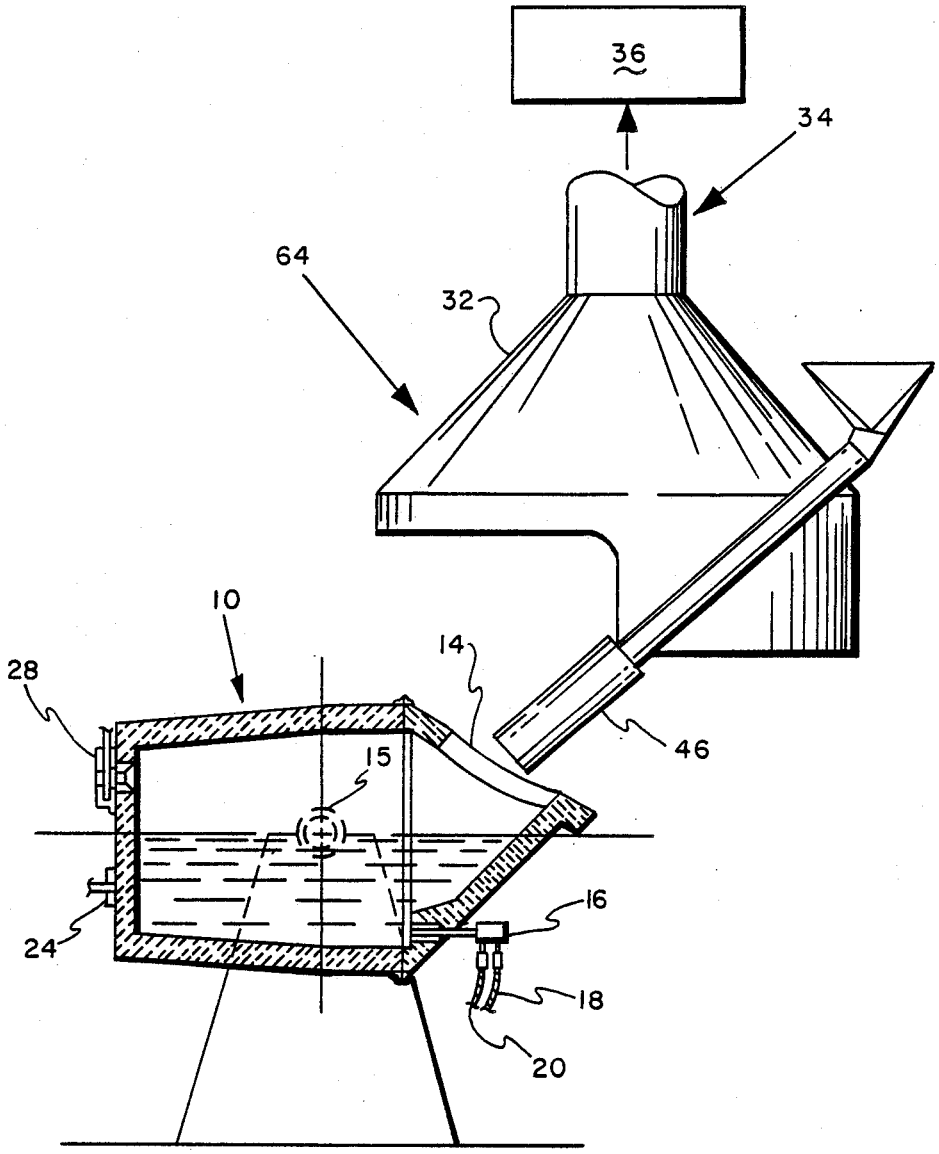
FIG. 3 is a sectional view of the vessel, tilted into the generally horizontal charging position, along with an associated positionable charging chute and a partially cut away fume collection hood.

The refractory lined vessel top 12 is provided with an offset opening 14 at one side, to permit the escape of gases and fumes generated during the melting and refining operation, to permit charging of the hot DRI pellets and scrap into the vessel 10 during the melting and refining operation and to direct the escaping gases and fumes into a collection hood 32 as shown in FIG. 3. The hood 32 is connected to an exhaust fan 34 and a conventional fabric filter or wet scrubber 36 to clean the waste gases to meet environmental standards prior to discharge into the atmosphere. The ladle cover 12 is generally conical, but inclined toward the charging opening.

In normal operation, the vessel is transported by an overhead traveling crane 56 or suitable mobile equipment between a series of individual stations placed to suit a specific plant layout as shown in FIG. 1.

At the final teeming station, for either ingot or continuous casting, a small amount of liquid steel is allowed to remain in the vessel, that is, the vessel is not completely drained. This remaining heel 62 should not be in excess of 15% of the original volume of molten steel in the vessel 10 and is used as ignition source or starter for the next batch or heat of steel to be processed in this vessel 10.

Assuming this vessel is continuing in operation, i.e. the refractory lining does not indicate the need for replacement, the vessel 10 will immediately be recycled to the melting/refining station 64. Should vessel lining need replacement or major repair be necessary, the vessel 10 is drained completely at the teeming station 72 and shunted out of the operating system to a repair area and a newly repaired and reheated vessel 10 is brought to the melting/refining station 64 in its place. Since this replacement vessel 10 does not contain the normal molten steel heel that a recycled unit would contain, the necess ry heel is supplied from a small source of molten iron maintained in a separate supplemental induction furnace 48. The induction furnace 48 normally melts iron scrap and holds it in a molten state or provides the heel 62 as described above and also the initial ignition sources required to start up the entire facility after a normal or abnormal shutdown for repair, or after down turns. The heel could come from the vessel taken out of service, or from any other vessel having molten steel therein.

By maintaining a small supply of additional vessels in good repair, a damaged or defective vessel can be removed from the steelmaking process system for repair off line, and a replacement vessel is substituted with no downtime and no loss of production, as depicted in FIG. 1.

Figure 4:
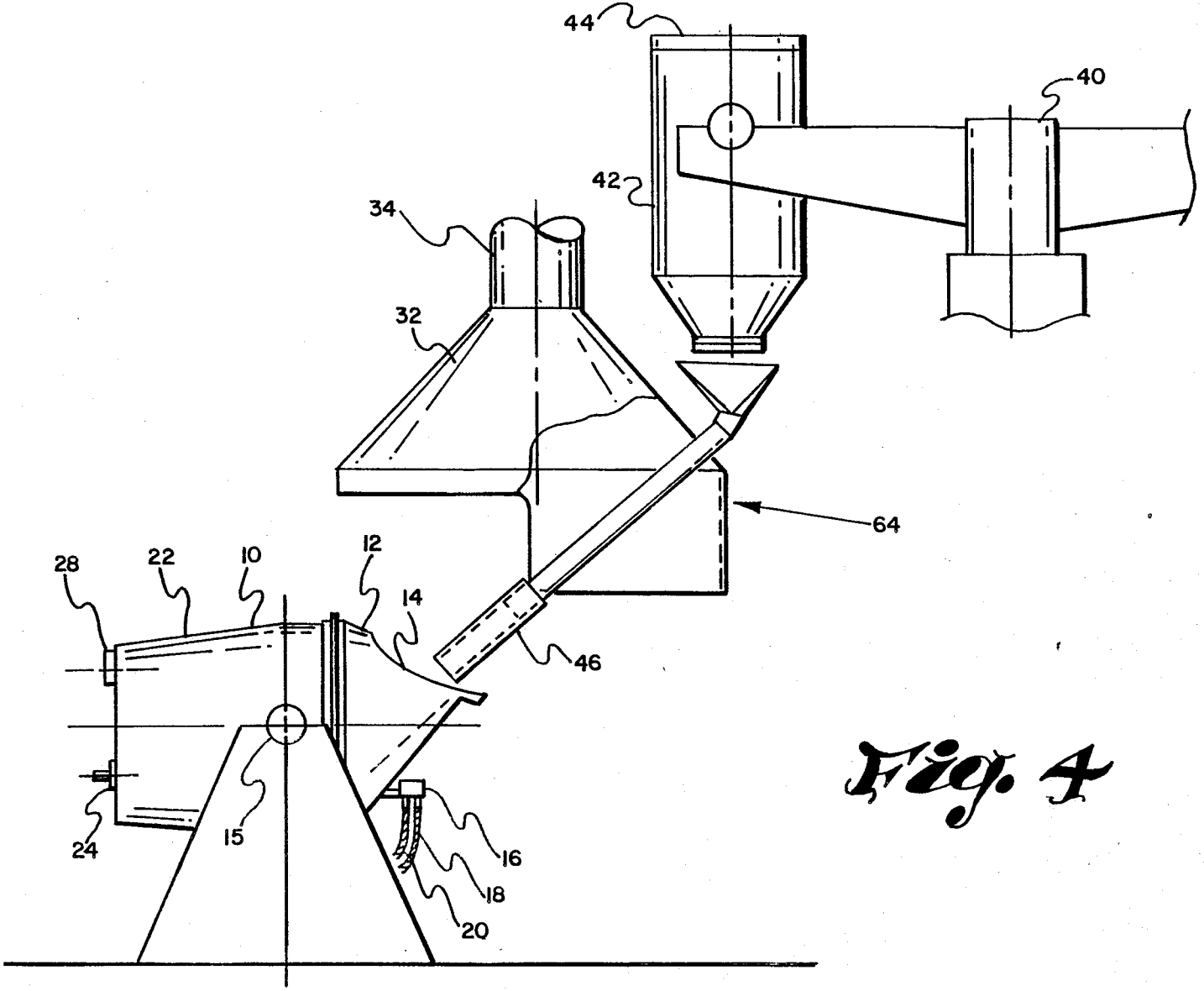
FIG. 4 is an elevational view of the vessel, tilted into the charging position, along with an associated positionable charging chute and associated charging apparatus.
Figure 5:
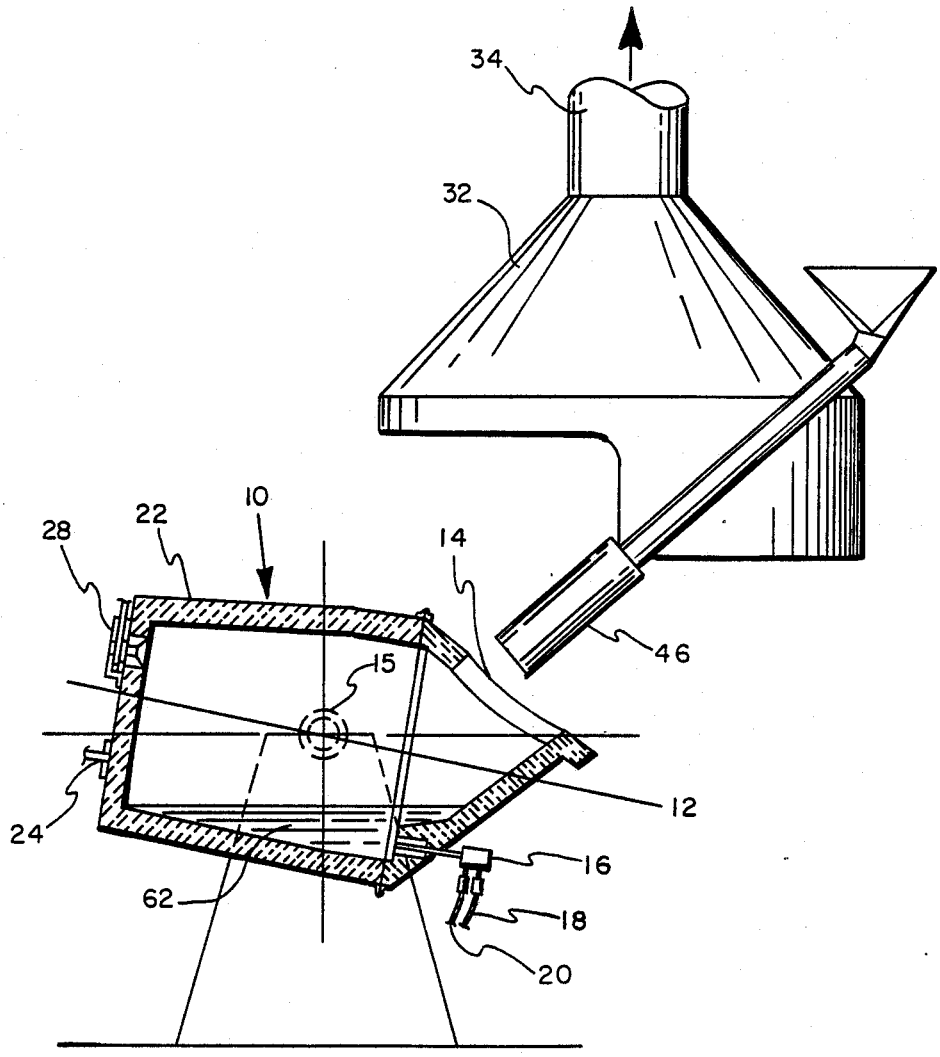
FIG. 5 is a sectional view of the vessel, tilted into the refining position, along with the associated equipment shown in FIG. 3.

At the melting/refining station 64, flexible hoses 18, 20 conducting the oxygen and cooling gas are connected to the tuyeres 16, and the vessel 10 is rotated to a slightly over-horizontal position as shown in FIG. 4. This permits the small liquid metal heel 62 to submerge the tuyeres 16 and start the refining process upon initiating gas flow. Oxygen and cooling gas flow is initiated through the tuyeres 16 prior to submergence to preclude damage to and plugging of the tuyeres 16.

Immediately upon reaching the over-horizontal position, the charging of hot carbon-containing DRI pellets 58 (see FIG. 1) is commenced through a positionable chute 46, as shown in FIG. 4. In this position the tuyeres 16 are in the underbath blowing position for blowing the melt down to the proper carbon content. A hood 32 is provided to collect the escaping gases and particulates from vessel opening 14. To provide the required thermal efficiency of the invention, it is necessary that the temperature of the DRI pellets 58 be at least 600 C.–800 C. at the time of their introduction to the vessel. Lesser DRI temperature could cause chilling and solidification of the molten steel heel 62 because sufficient carbon is absorbed into the bath to sustain the operation.

It is also necessary that the hot DRI pellets 58 charged to the vessel contain at least 2% carbon. This carbon is released into the molten bath and, by exothermic reaction with the injected oxygen, provides the energy needed to melt the continuously fed hot DRI pellets 58. Hot DRI pellets 58 containing at least 2% carbon can be produced by means such as the Holley process in a facility adjacent to the steelmaking facility. The hot DRI pellets 58 produced are collected in an intermediate bin 59, or in refractory lined and insulated containers 42. When loaded, these containers 42 are closed by lids 44 to prevent reoxidation of the hot DRI pellets 58 and transported to the steelmaking facility. There they are placed on a turnstile device 40 similar to that shown in FIG. 4. The turnstile device 40 indexes and positions the full container 42 over the chute 46, feeding the vessel, then moves the emptied container 42 to an opposite unloading/loading station 66. The emptied container 42 is removed and sent back to the DRI pellet facility for re-filling and a full container 42 placed on the turnstile 40 in order to repeat the charging cycle.

As the volume of molten and refined molten metal increases, vessel 10 is rotated slowly back toward a horizontal position. Slag formed during the melting/refining operation is periodically drained by lip pouring, that is, by tilting the vessel 10 over horizontally until the slag flows out through the vessel's top opening 14. When the desired amount of slag remains, the vessel 10 is rotated again back to the horizontal position, cutting off the flow of slag, all of which is accomplished without stopping the melting and refining process. Slag conditioning agents or additives can be introduced to the vessel along with the hot DRI pellets 58 through the same feed chute 46.

When the desired amount of DRI pellets 58 have been introduced, the pellet flow is halted and oxygen injection is continued until the molten metal has been refined to the desired carbon level. As this carbon level is approached, the vessel 10 is rotated to an upright position. When the tuyeres 16 are clear of the molten steel bath, oxygen flow is discontinued and the cooling gas flow maintained. This prevents undue burning of the tuyeres 16 caused by the high heat generated during the oxygen flow and cools the tuyeres 16 to a sufficient degree to preclude damage from the hot refractory vessel lining.

When the vessel reaches the upright position, the cooling gas flow is also halted and the gas supply lines or hoses 18, 20 are disconnected from the tuyeres 16. Overhead crane 56 or other mobile equipment is positioned to remove the vessel 10 from this station as soon as the tilting mechanism 68 is disengaged.

The vessel 10, loaded with molten steel, is moved to the ladle metallurgy station 65 for adjustment of chemistry by alloy additions, wire feeding, micro alloy injection and stirring by argon/nitrogen mix via the porous plug 24 for homogenization of the melt.

If temperature adjustment is necessary, the temperature can be lowered by continued gaseous stirring or, in extreme cases, by scrap additions. If an increase in temperature is needed, the induction coil 50 opposite stainless steel section 30 in the vessel sidewall is energized. In this case, gaseous stirring is discontinued. The electro-mechanical stirring induced by the coil is ample to produce the homogeneity desired or needed.

As soon as the melting/refining station 64 is emptied of the above vessel 10, a vessel 10 from the teeming station 72 containing a molten steel heel, or a preheated vessel 10 from the repair area, is moved into position and the melting/refining operation commenced with this vessel 10.

Upon completion of the ladle metallurgy operation, the vessel 10 is moved to the teeming station 72. The melting/refining and teeming operations can be as to be competed in a 60 minute time cycle. The ladle metallurgy operation will generally be completed in a less than 60 minute period. At this station, the vessel 10 can be held for extended periods if necessary and temperature maintained by the induction coil 50. In extreme cases, several vessels 10 loaded with molten steel could be shuttled in and out of this station to maintain metal temperature in each vessel 10 until normal sequential operation is resumed.

SUMMARY OF THE ACHIEVEMENTS OF THE OBJECTS OF THE INVENTION

From the foregoing, it is readily apparent that we have invented a useful device and method for melting, refining, ladle metallurgy, and teeming of metal. The invention provides means for melting and refining of metal and transporting the molten metal to subsequent steelmaking operations without transferring the metal to a separate transport vessel; means for avoiding oxidation of non-metallics in the molten steel from exposure of the metal stream to atmospheric oxygen during the transfer operation; means for removing a vessel from the steelmaking process for repair off line, and for substituting a replacement vessel with no downtime and no loss of production.

The vessel's removable close fitting cover minimizes temperature losses by radiation. The vessel can be removed from service and fitted with a rebuilt refractory top section without the necessity of installing new refractory in the entire vessel, by a simple refractory replacement method using ramming machines to automatically line the top and bottom portions of the vessel with refractory.

Only minimal external energy sources are required, as the process has improved the thermal efficiency by utilizing hot DRI pellets as feed material. The need for complicated addition of carbon into the vessel by injection tuyeres or other similar devices has been eliminated, as well as the need to provide the crushing, storage and transport systems normally required for carbon injection.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. A vessel for melting, refining, ladle metallurgy, and teeming of metal, comprising:

(a) a refractory lined ladle;

(b) a removable refractory lined ladle cover adapted to engage said refractory lined ladle, said ladle cover having an opening to permit charging therethrough as well as to permit the escape of gases and fumes;

(c) means for mounting said vessel and for tilting said vessel to a generally horizontal refining position;

(d) means integral with said removable refractory lined ladle cover for injecting oxygen through the refractory lined ladle cover, under the surface of, and directly into, the metal bath contained in the vessel when the vessel is in the generally horizontal refining position;

(e) means for introducing inert gas into the vessel for promoting homogeneity of chemistry and temperature of the metal contained in the vessel; and (f) tapping means for removing molten metal from the ladle.

2. The vessel as set forth in claim 1, wherein said oxygen injecting means comprises at least one tuyere situated in said refractory lined ladle cover.

3. The vessel as set forth in claim 1, wherein said inert gas introducing means comprises a porous plug positioned in the base of said ladle, and connected to a source of inert gas.

4. The vessel as set forth in claim 1, wherein said tapping means comprises a sliding gate type tapping valve positioned on the base of said ladle.

5. The vessel as set forth in claim 1, wherein the mounting and tilting means comprises trunnions for rotation about a horizontal axis of the vessel to a generally horizontal position and to a vertical position.

6. The vessel as set forth in claim 1, further comprising means for transporting the vessel.

7. The vessel as set forth in claim 1, having a steel shell, wherein a portion of said shell is non-magnetic.

8. The vessel as set forth in claim 7, further comprising induction heating means adapted for engagement with said non-magnetic portion of said shell.

9. The vessel as set forth in claim 1, further comprising a stainless steel insert in the sidewall of said ladle and an associated induction coil.

10. A method for melting, refining, ladle metallurgy, and teeming molten metal, comprising the steps of:

(a) selecting a vessel provided with a removable refractory lined ladle cover having an opening therein, and means integral with the cover for injecting oxygen through the cover into a metal bath contained in the vessel, from a plurality of stored like vessels;

(b) providing the vessel with a heel of molten metal;

(c) transporting the vessel to a melting/refining station and engaging a tilting mechanism;

(d) attaching oxygen and cooling gas supply lines to at least one tuyere in the cover;

(e) rotating the vessel to a position slightly beyond horizontal;

(f) introducing oxygen and cooling gases into the vessel through the tuyere;

(g) charging carbon-containing metallized iron in pellet or lump form into the vessel;

(h) removing slag from the vessel as necessary;

(i) ceasing metallized iron charging after a predetermined amount of charge material has been introduced into the vessel;
(j) melting and refining the charge material by continuing oxygen injection until the carbon content of the hot metal has reached a predetermined level;
(k) rotating the vessel to an upright position;
(l) terminating oxygen injection after the tuyere has cleared the molten metal in the vessel;
(m) continuing injection of cooling gas through the tuyere until the vessel reaches an upright position;
(n) disconnecting the supply lines from the tuyere in the cover;
(o) disengaging the tilting mechanism from the vessel;
(p) transporting the vessel to a ladle metallurgy station;
(q) adjusting the chemistry of the molten metal as required;
(r) increasing the temperature of the molten metal, as required, for promoting desired chemical reactions;
(s) reducing the temperature of the molten metal as required;
(t) transporting the vessel to a teeming station upon completion of ladle metallurgy;
(u) teeming the metal;
(v) determining whether vessel repair is necessary;
(w) fully draining and removing the vessel from the system and returning to step (a) if the vessel is need of repair; and
(x) partially draining the vessel and returning to step (c) if the vessel is not in need of repair.

11. A method according to claim 10 wherein temperature reduction is accomplished by gaseous stirring.

12. A method according to claim 10 wherein temperature reduction is accomplished by adding cold scrap to the molten metal in the vessel.

13. A method according to claim 10 wherein metal is maintained in a molten condition in a supplemental induction furnace, and a heel of molten metal is provided from the supplemental induction furnace.

14. A method according to claim 8 wherein the vessel is provided with a stainless steel panel of sidewall in the vessel and an induction coil is placed in the proximity of the vessel to provide supplemental heating or stirring.

15. A method according to claim 10 wherein the carbon-containing metallized iron is in the form of direct reduced iron pellets.

16. A method according to claim 10 wherein slag removal is accomplished by lip pouring through the opening in the cover.

17. A method according to claim 10 wherein the chemistry of the molten metal in the vessel is adjusted by injecting an argon/nitrogen gas mixture at the ladle metallurgy station.

18. A method according to claim 10 wherein the temperature of the molten metal is increased by induction heating.

19. A method of making steel, comprising:
providing a tiltable ladle having a cover thereon and a charging opening to one side in the cover, the ladle being provided with trunnions;
providing the vessel with a molten metal heel therein;
positioning the ladle so that its normally vertical center line is substantially horizontal with the charging opening in the ladle cover being oriented generally upward;
charging the vessel with direct reduced iron pellets into the molten metal heel;
injecting oxygen and cooling gases into the vessel through the ladle cover beneath the surface of the molten metal therein, and refining the molten metal to a predetermined composition;
repositioning the ladle to a vertical orientation;
removing the ladle from the charging and refining station;
and teeming the molten metal into a receiving vessel.

* * * * *